US011174613B2

(12) United States Patent
Haas

(10) Patent No.: US 11,174,613 B2
(45) Date of Patent: Nov. 16, 2021

(54) SECURING MEANS FOR SECURING A CIVIL ENGINEERING ELEMENT, AND CIVIL ENGINEERING METHOD

(71) Applicant: BAUER Maschinen GmbH, Schrobenhausen (DE)

(72) Inventor: Josef Haas, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 16/815,143

(22) Filed: Mar. 11, 2020

(65) Prior Publication Data

US 2020/0291595 A1 Sep. 17, 2020

(30) Foreign Application Priority Data

Mar. 13, 2019 (EP) ..... 19162495

(51) Int. Cl.
*E02D 13/00* (2006.01)
*E02D 7/02* (2006.01)
*E02D 9/02* (2006.01)

(52) U.S. Cl.
CPC ..... *E02D 13/00* (2013.01); *E02D 7/02* (2013.01); *E02D 9/02* (2013.01); *E02D 2600/10* (2013.01)

(58) Field of Classification Search
CPC ..... E02D 13/00; E02D 7/02; E02D 9/02
See application file for complete search history.

(56) References Cited

U.S. PATENT DOCUMENTS 5,332,047 A 7/1994 Hignite
7,015,813 B1 * 3/2006 Loster ..... E02D 13/06 340/568.1
2002/0063245 A1 5/2002 Salman
2016/0076216 A1 * 3/2016 Stokholm ..... E02D 7/08 173/1

(Continued)

FOREIGN PATENT DOCUMENTS

DE 3602609 A1 7/1987
DE 9318190 U1 1/1994
DE 10322207 A1 12/2004

(Continued)

OTHER PUBLICATIONS

An Examination Report mailed by the Australian Patent Office dated Nov. 19, 2020, which corresponds to Australian Patent Application 2020201592 and is related to U.S. Appl. No. 16/815,143.

*Primary Examiner* — Sean D Andrish
(74) *Attorney, Agent, or Firm* — Studebaker & Brackett PC

(57) ABSTRACT

The invention relates to a securing means and a method for securing a civil engineering element to a construction machine by means of a flexible securing element, wherein a first end of the flexible securing element is attached to the construction machine and a second end is provided with a connecting link which can pass through a securing lug on the civil engineering element and can be releasably fastened to the construction machine by a connecting means. According to the invention, a detection unit is provided on the connecting means, which detection unit is designed for identifying fastening of the connecting link to the connecting means. The detection unit can generate and output a signal if fastening of the connecting link is identified.

15 Claims, 6 Drawing Sheets

(56) References Cited

U.S. PATENT DOCUMENTS

| | | | | |
|---|---|---|---|---|
| 2016/0130777 | A1* | 5/2016 | Stam | E02D 7/02 405/228 |
| 2019/0195201 | A1* | 6/2019 | Thrue | E02D 27/52 |

FOREIGN PATENT DOCUMENTS

| | | | |
|---|---|---|---|
| EP | 0857830 | * | 12/1998 |
| EP | 3000942 | A1 | 3/2016 |
| EP | 3228392 | A1 | 10/2017 |

* cited by examiner

SECURING MEANS FOR SECURING A CIVIL ENGINEERING ELEMENT, AND CIVIL ENGINEERING METHOD

CROSS-REFERENCE TO RELATED APPLICATIONS

This application claims the benefit of priority to European Patent Office Patent Application No. EP19162495, filed on Mar. 13, 2019, which is hereby incorporated by reference in its entirety.

TECHNICAL FIELD

This disclosure relates to a securing means for securing a civil engineering element to a construction machine, in particular a pile to a pile driver, by means of a flexible securing element, in particular a securing chain, wherein a first end of the flexible securing element is attached to the construction machine and a second end is provided with a connecting link which can pass through a securing lug on the civil engineering element and can be releasably fastened to the construction machine by a connecting means.

This disclosure further relates to a civil engineering method, in which a civil engineering element is fixed to a construction machine, in particular a pile to a pile driver, by means of a flexible securing element, in particular a securing chain, wherein a first end of the flexible securing element is attached to the construction machine and a second end is provided with a connecting link which is passed through a securing lug on the civil engineering element and releasably fastened to the construction machine by a connecting means in order to secure the position of the civil engineering element on the construction machine.

BACKGROUND

A securing means of the type in question is disclosed by DE 3 602 609 A1. A sheet pile can be loosely fastened to a vibration means, using chain anchoring. In this case, a securing chain is guided through a through-hole or a securing lug at an upper end region of the pile. In this case, one end of the securing chain is fastened to the vibration means. The loose end is fastened to the vibration means by a plug connection, after being guided through.

Subsequently, the vibration means can be moved upwards along a mast, wherein the sheet pile is retained by the chain anchoring and drawn upwards, wherein an upper end of the sheet pile enters into a receiving slot of the vibration means, between two clamping jaws. Subsequently, the sheet pile can be clamped on the vibration means, between the two clamping jaws. It is then possible for the clamped sheet pile to be driven or rammed vertically into the ground, using the vibration means.

After a civil engineering measure has been completed, it is often necessary or desirable to remove the sheet pile from the ground again. For this purpose, the known pile driver can also be used, wherein the securing chain is to be passed through the securing lug on the sheet pile again, prior to pulling the sheet pile, in order to thereby additionally secure the sheet pile on the pile driver or the vibration means. Subsequently, the upper end of the pile is clamped again and drawn out of the ground in a jolting manner, by the vibration means. In this case, the securing chain functions as an additional mechanical position securing means in order that the pile does not fall to the ground in an uncontrolled manner, for example in the event of the hydraulic clamping means failing. Furthermore, the pile is placed on the ground again using the securing chain, following release of the clamping jaws.

A similar arrangement of a pile driver is known from U.S. Pat. No. 5,332,047. In this known apparatus a pole-shaped pile is driven into the ground, wherein a securing chain is likewise arranged between the pile and the pile driver.

The securing chain functions as an additional mechanical position securing means for the pile, which is generally a steel part that is up to 10 m or more in length and has a weight of several 100 kg. In the case of hydraulic clamping means, malfunctions, incorrect operation, or damage of the hydraulic system may result in unexpected release or reduction of the hydraulic clamping force. Without an additional mechanical position securing means being present by virtue of the securing chain, there is a risk that the pile may fall to the ground, from a vertical position, and in the process may lead to material damage or personal injury. Numerous fatal accidents have been recorded.

In practice, it may be the case that construction site staff may forget to attach the securing chain, or that said securing chain may not be correctly fastened. This poses a significant danger to occupational safety.

SUMMARY

An object of the disclosure is that of specifying a securing means and a civil engineering method, by means of which a particularly high degree of occupational safety is ensured.

The object is achieved according to the disclosure by a securing means having the features of a flexible securing element, in particular a securing chain, wherein a first end of the flexible securing element is attached to the construction machine and a second end is provided with a connecting link which can pass through a securing lug on the civil engineering element and can be releasably fastened to the construction machine by a connecting means. A detection unit is provided on the connecting means, which detection unit is designed for identifying fastening of the connecting link to the connecting means. The detection unit can generate and output a signal if fastening of the connecting link is identified. The object is also achieved according to the disclosure by a civil engineering method having the features of using a securing means as described herein in which a civil engineering element is fixed to a construction machine, in particular a pile to a pile driver, by means of a flexible securing element, in particular a securing chain. A first end of the flexible securing element is attached to the construction machine and a second end is provided with a connecting link which is passed through a securing lug on the civil engineering element and releasably fastened to the construction machine by a connecting means in order to secure the position of the civil engineering element on the construction machine. A detection unit is provided on the connecting means, which detection unit is designed to identify fastening of the connecting link to the connecting means, and the detection unit can generate and output a signal when fastening and/or a lack of fastening of the connecting link is identified. Preferred embodiments of the disclosure are described herein.

The securing means according to the disclosure is characterised in that a detection unit is provided on the connecting means, which detection unit is designed to identify fastening of the connecting link to the connecting means, and in that the detection unit can generate and output a signal when fastening of the connecting link is identified.

A core concept of the disclosure is that of verifying correct closing of the flexible securing element on the connecting link. For this purpose, a detection unit is arranged on the connecting means, which detection unit identifies reception and fastening of the connecting link on the connecting means. In this case, the detector unit outputs a signal, in particular an electrical signal, if correct fastening of the connecting link has been achieved. In addition or alternatively, the detection unit can also output a signal if no or incorrect fastening of the connecting link has taken place.

The signal can be displayed directly to a machine operator, for example in an operating state. The signal can also actuate a corresponding alarm which is in particular optically and/or acoustically operated. The signal can, however, also be fed to a corresponding control unit of the construction machine, wherein the control unit then intervenes correspondingly in the further course of operation. In particular, further operation of the construction machine can be stopped or at least restricted, for example in that clamping of the pile on the pile driver cannot be released, or a movement of the pile drive unit cannot be started, until correct fastening of the connecting link has been achieved.

A preferred development of the disclosure consists of at least one locking bolt being provided on the connecting means, by means of which the connecting link can be locked in the connecting means. The at least one locking bolt that constitutes mechanical blocking of the connecting link in the connecting means. Alternatively or in addition, the detection unit can identify the position of the locking bolt.

In this case it is particularly preferable, according to a development of the disclosure, for the locking bolt to be adjustable between a retracted position, for receiving or releasing the connecting link in the connecting means, and a locking position, in which the connecting link is locked in the connecting means. In the retracted position, the locking bolt can be retained by means of catching, in a manner requiring low force. This allows for simple insertion of the connecting link into the connecting means, and subsequent locking by means of moving the locking bolt into the locking position. Alternatively, the locking bolt can also be retained in the locking position in a spring-loaded manner. In order to insert the connecting link, the locking bolt is briefly pulled back, counter to the spring force, wherein said bolt is then pushed back into the locking position, by the spring force, after the connecting link has been inserted into a corresponding lock of the connecting means. The locking can be actuated manually, or preferably by means of an activatable actuating member, for example a hydraulic actuating cylinder.

A particularly expedient variant of the disclosure can be considered that of the position of the connecting link in the locking position being able to be identified by the detection unit. This can take place in isolation, or in addition to identifying the position of the locking bolt. A particularly high degree of identification reliability is achieved thereby.

A particularly efficient variant of the disclosure results from the detection unit comprising at least one proximity sensor. A proximity sensor is a robust, and overall cost-effective, sensor element. As a result, the detection unit can be designed in a particularly economical and reliable manner.

In this case, it is particularly advantageous for the proximity sensor to be able to identify when the connecting link is in the connecting means. At the same time, the same or a further proximity sensor can also identify the position of the locking bolt, in order to increase the degree of reliability of the identification.

According to a further embodiment of the disclosure, it is preferable for the flexible securing element to be electrically conductive and for an electrical energy source to be provided, by means of which a test current can be conducted between a fastening element, to which the first end of the flexible securing element is attached, and the connection means through the flexible securing element, which current can be identified by the detection unit. The electrical energy source can in particular be a current or voltage source, by means of which a test current is generated continuously or at specific times. If the flexible securing element is correctly connected to the connecting means, a test current is conducted from the fastening element at one end of the flexible securing element, to the other end thereof at the connection means. Said security assembly may be provided in addition to or instead of the detection assembly described above. The flexible securing element can for example be a steel cable or a chain made of metal or electrically conductive chain links. When a cable is used, said cable can be provided with or formed by a correspondingly electrically conductive material only on the outer or inner face thereof.

In this case, it is particularly expedient for the fastening element and the connecting means to be electrically insulated with respect to the construction machine. As a result, leakage currents are prevented. The electrical insulation can be achieved by means of corresponding electrically insulating materials. It is particularly advantageous for the fastening element and the connecting means to be fastened to the construction machine by means of a rubber buffer. This achieves not only electrical insulation, but also acoustic insulation, and thus a reduction in the sound radiation.

The disclosure also relates to a construction machine, in particular a pile driver, for driving a pile into the ground, wherein the above-described securing means is provided.

In this case, the pile driver comprises a pile drive unit which is used for driving the pile, in particular a post, a girder or a sheet pile, into the ground by means of vibrations or pulses. In this case, the pile drive unit can be a shaker comprising rotatable unbalancing elements or a pile driver comprising a pulse element that can be driven in a linearly reversing manner. In this case, the shaker can comprise one or more pairs of rotatable unbalancing elements which are mounted so as to be adjustable relative to one another, in a known manner, for generating a directed unbalance. Alternatively, the pile drive unit may be a pile hammer. In this case, the ramming movement can trigger striking pulses, in the case of which the pulse element, which is driven in a reversing manner, strikes a striking surface. Alternatively, the pulse element can also be driven in a reversing manner without striking contact, such that a purposeful vibrational movement is generated and transferred to the pile.

The construction machine may comprise a mobile carrier device on which a mast is arranged. The pile drive unit can be mounted so as to be vertically adjustable along the mast. The carrier device can in particular comprise a crawler chassis, on which a rotatable superstructure comprising a boom for cable suspension or a vertical mast comprising a slotted guide, in particular a telescopic leader mast.

The civil engineering method is characterised in that a connecting means of a detection unit is provided, which detection unit can identify fastening of the connecting link to the connecting means, and in that the detector unit generates and outputs a signal when fastening and/or a lack of fastening of the connecting link is identified.

The civil engineering method can in particular be carried out using the security device described above. The advantages described in this case can be achieved.

A preferred method variant of the disclosure consists in the construction machine being a pile driver, by means of which a pile, as a civil engineering element, is driven into or drawn out of the ground. The pile may be a post, a girder, a pipe, a sheet pile, etc. In particular when driving in a sheet pile, it is possible for a plurality of civil engineering elements of this kind to be driven in, such that what is known as a sheet pile wall is formed.

Advantages and features of the embodiments of this disclosure will become more apparent from the following detailed description of exemplary embodiments when viewed in conjunction with the accompanying drawings.

DETAILED DESCRIPTION

Figure 1:
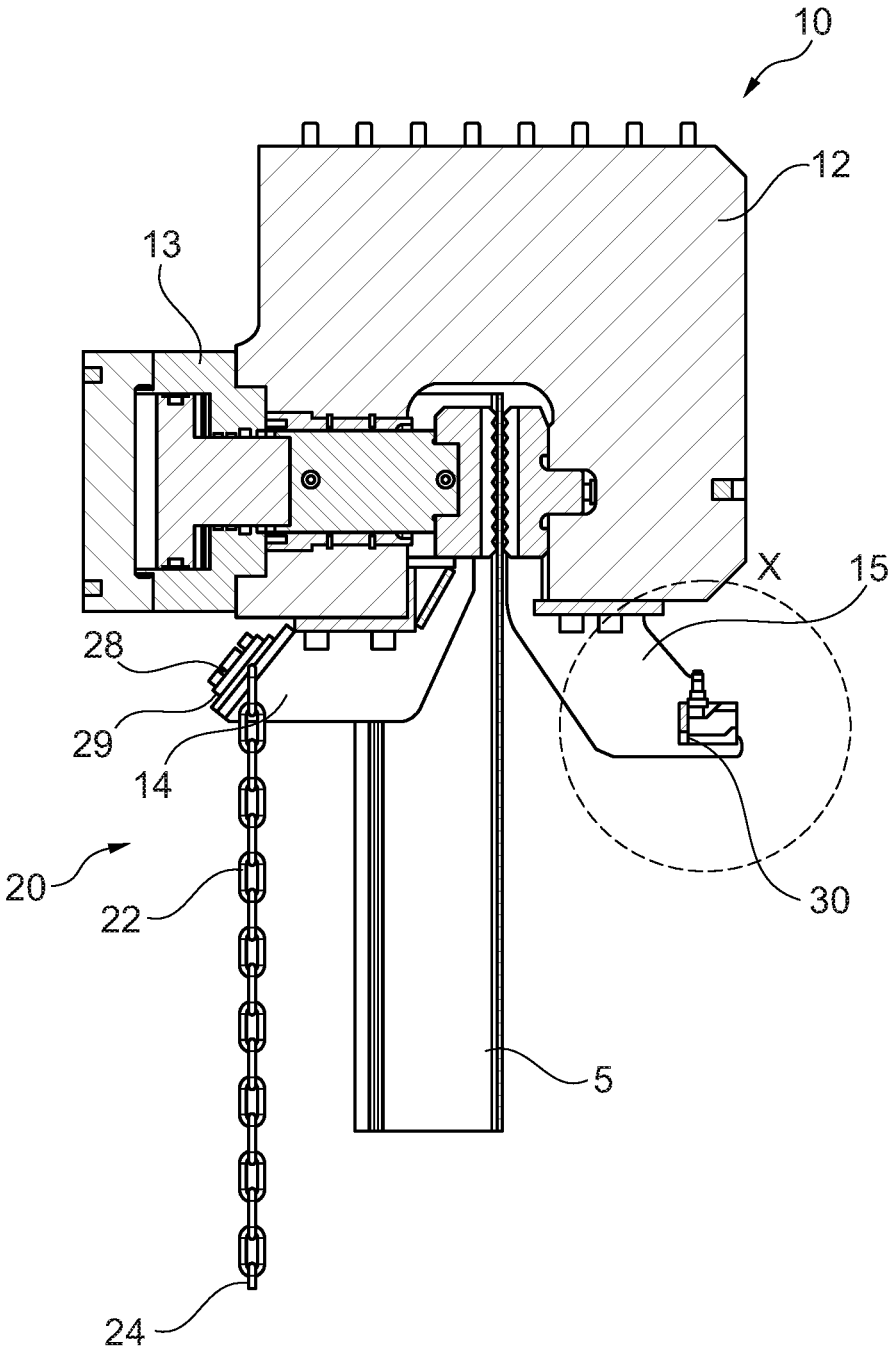
FIG. 1 is a cross-sectional view through a part of a construction machine comprising a securing means according to the disclosure, in an open state.
Figure 2:
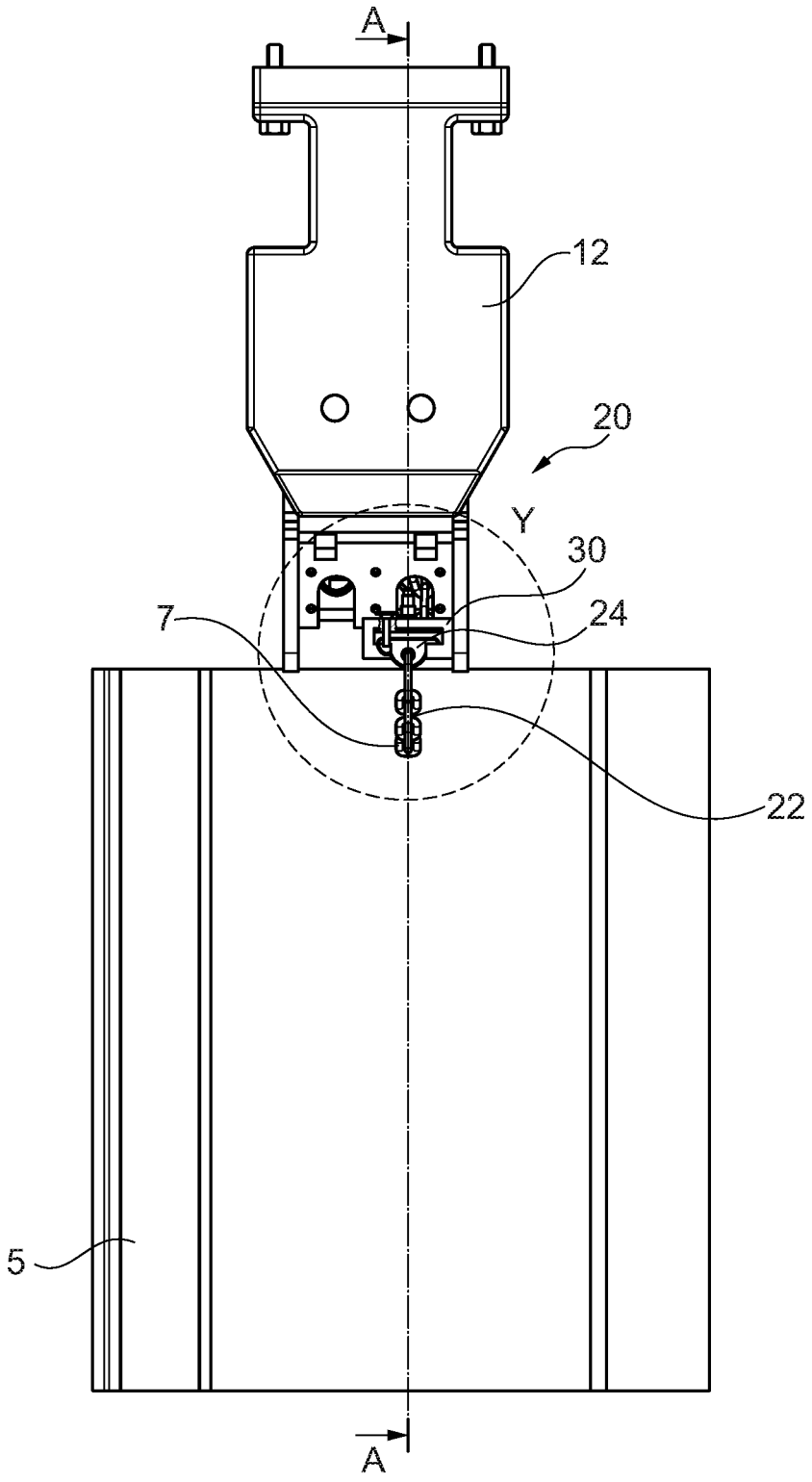
FIG. 2 is a front view of the securing means of FIG. 1, in a closed state.
Figure 3:
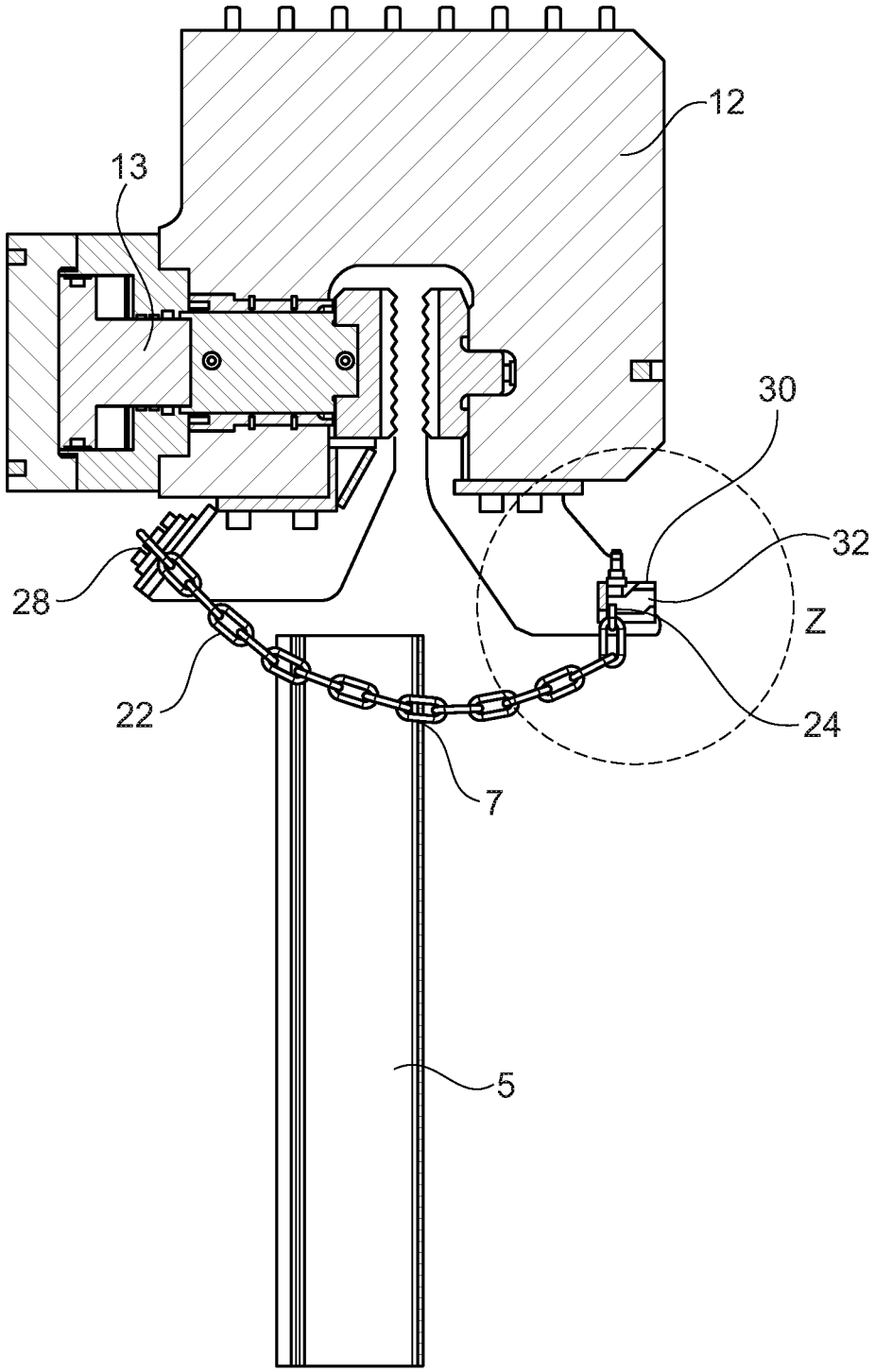
FIG. 3 is a cross-sectional view of the securing means of FIG. 2, along the line A-A.

The fundamental design of a securing means 20 according to the disclosure on a construction machine 10 is shown in FIGS. 1 to 3. The construction machine 10 (which is shown only in part) comprise a pile drive unit 12 which can comprise rotatably driveable unbalancing means in a manner that is known in principle. A hydraulic clamping means 13 is arranged on a lower region of the pile drive unit 12, by means of which clamping means a civil engineering element 5, which is a sheet pile in the embodiment shown, can be firmly clamped between two clamping jaws.

In order to insert the pile-shaped civil engineering element 5 into the clamping means 13, a first insertion flank 14 and a second insertion flank 15 being arranged on the lower end of the pile drive unit 12, which insertion flanks together form an approximately V-shaped receiving slot. In order to additionally secure the position of the civil engineering element 5, a securing means 20 according to the disclosure is provided.

The securing means 20 comprises a flexible securing element 22 which, in the embodiment shown, is designed as a chain. A first end of the chain is fastened, by means of a plate-like fastening element 28, to the first insertion flank 14, and thus to the construction machine 10. An insulation layer 29 can be arranged between the fastening element 28 and the first insertion flank 14, by means of which insulating layer the fastening element 28 and thus the flexible securing element 22 is electrically insulated with respect to the construction machine 10.

Figure 4:
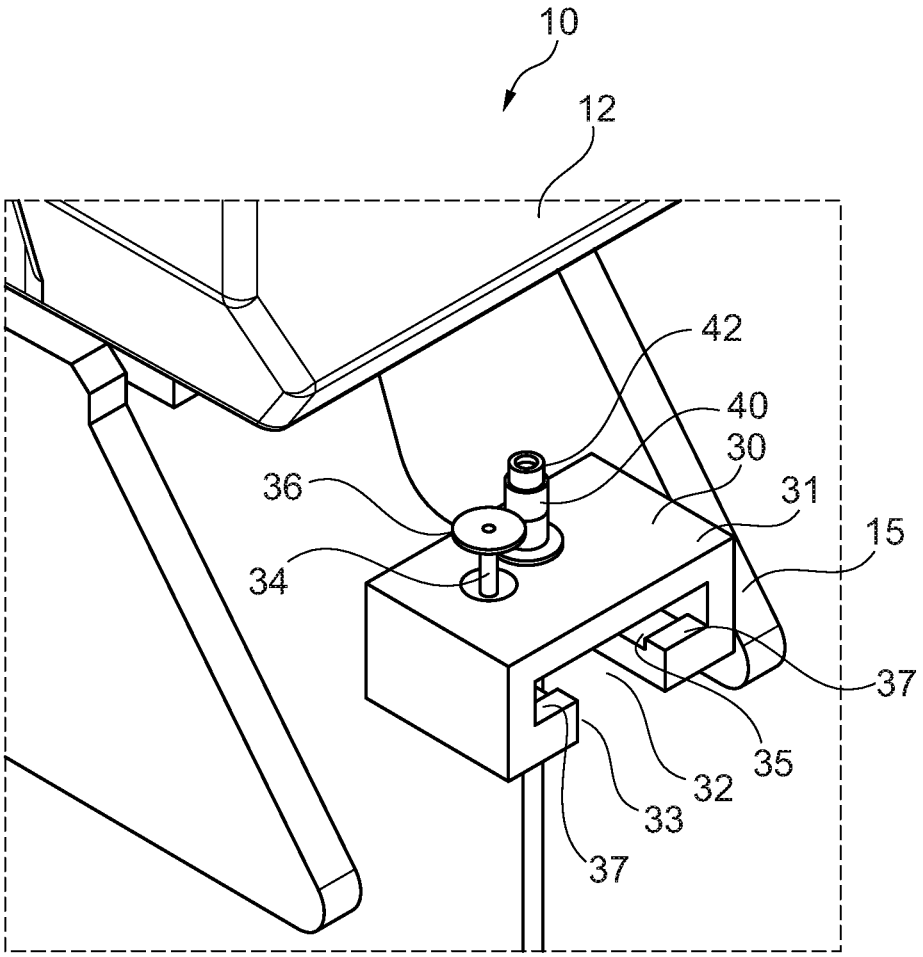
FIG. 4 is an enlarged perspective detail of a connecting means of the securing means according to FIG. 3.
Figure 5:
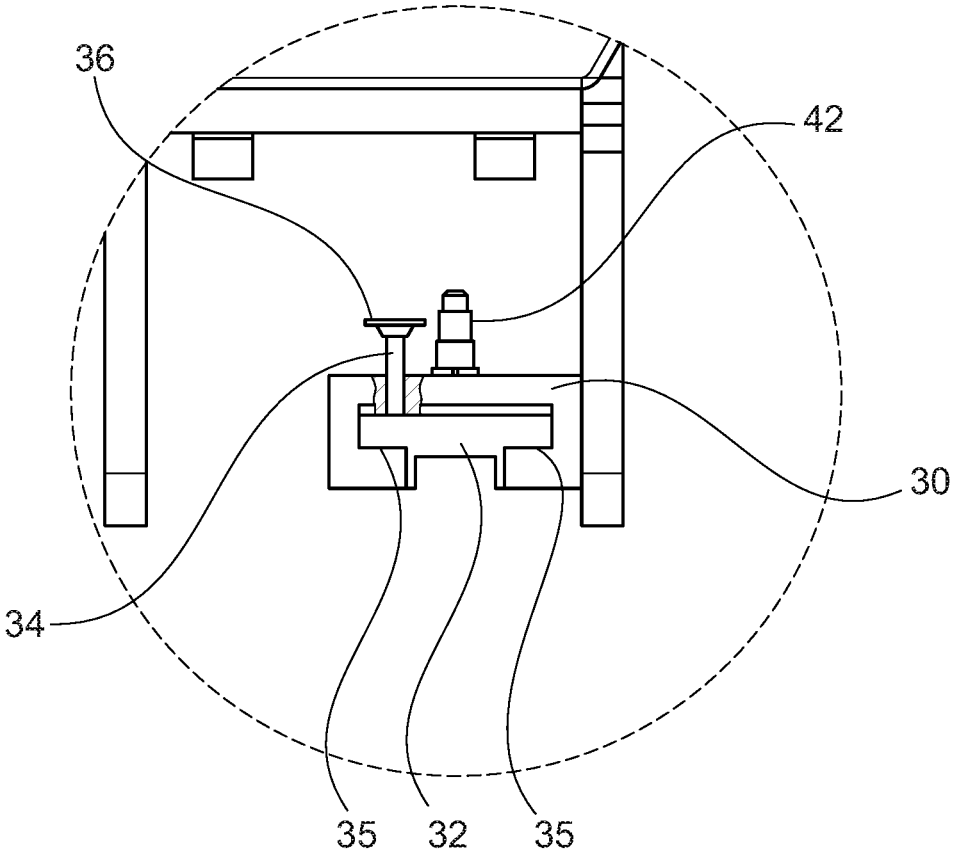
FIG. 5 is a front view of the connecting means according to FIG. 4.

A connecting link 24 is attached to the second end of the flexible securing element 22, which link is formed as an approximately T-shaped handle. The securing link 24 can be pushed through a through-hole or a securing lug 7 on the pile-shaped civil engineering element 5 and guided towards a connecting means 30 on the second insertion flank 15, as is clearly shown in FIGS. 2 and 3. The connecting link 24 can be inserted or pushed into a matching receptacle 32 on the box-shaped connecting means 30, wherein the connecting link 24 can be latched in the connecting means 30. FIGS. 4 and 5 show the box-shaped connecting means 30 in a state ready for receiving. In this case, a block-like housing 31 comprises a slot-like receptacle 32 for receiving the connecting link 24. The receptacle 32 is open on one side, which side is remote from the clamped civil engineering element 5.

Furthermore, a slot 33 is made in an underside of the housing 31, the slot width of which slot is designed so as to be smaller than the reception region of the receptacle 32 located thereabove. In this case, two lateral, track-like rests 35 are formed, on which the handle-like connecting link 24 can rest. The rests 35 can be designed having an upwardly protruding shoulder 37 towards the open side.

A proximity sensor 42, as a detection unit 40, is inserted into a corresponding locating bore, on an upper face of the housing 31. The proximity sensor 42 is designed to identify the presence of the connecting link 24 in the receptacle 32 of the connecting means 30. Furthermore, a vertically displaceable locking bolt 34 comprising an upper actuating plate 36 protrudes from a locating bore on the upper face of the housing 31. The locking bolt 34 comprising the actuating plate 36 is designed for mechanical operation by hand or by means of an actuating tool. It is also possible, however, for an active device (not shown), in particular an actuating member such as a pneumatic or hydraulic actuating cylinder to be provided for the purpose of actuation.

Figure 6:
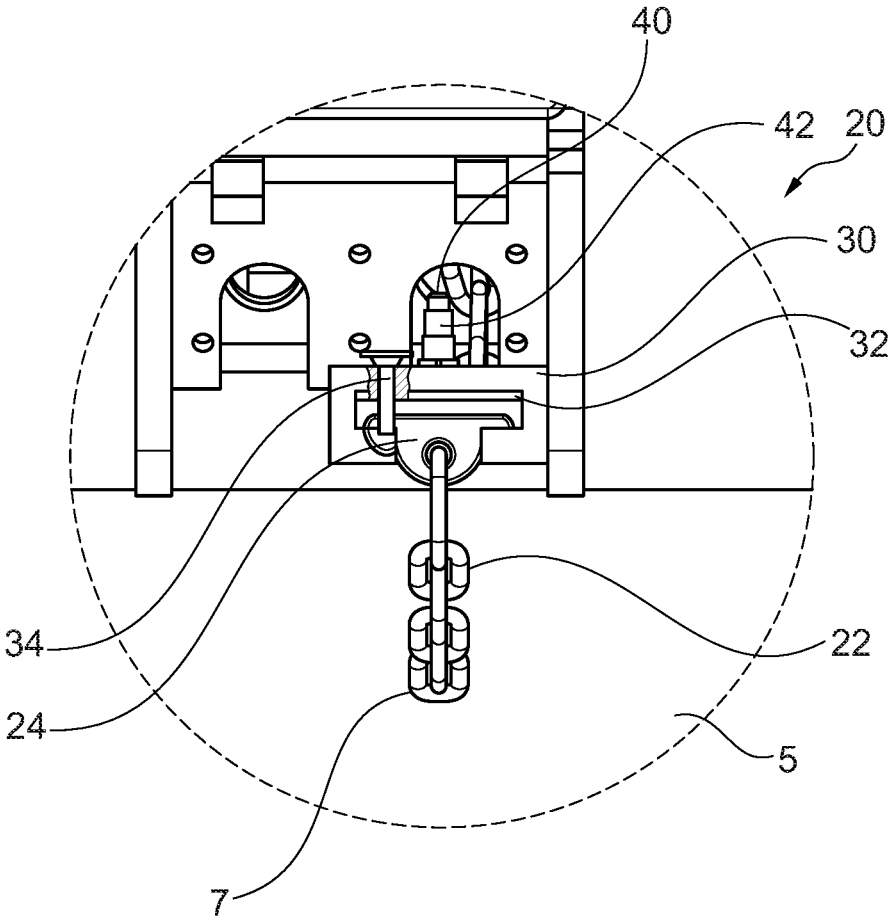
FIG. 6 is a front view of the connecting means of FIG. 5, comprising a received connecting link.

FIG. 6 shows the state of the securing means 20, in which the T-shaped connecting link 24 of the chain-like flexible securing element 22 is inserted into the receptacle 32 of the connecting means 30. In order to secure the connecting link 24 in position in the receptacle 32, the locking bolt 34 is adjusted downwards, from a retracted position into a locking position. In this position, the detection unit 40 can ascertain, by means of the proximity sensor 42, both the presence of the connecting link 24 in the connecting means 30 and adjustment of the locking bolt 34 in the locking position.

In this state, the detection unit 40 can output a signal to a control unit, signalling that the connecting link 24 is correctly attached in the connecting means 30, and thus the civil engineering element 5 is correctly secured by the flexible securing element 22.

While various embodiments of the disclosure have been shown and described, it should be understood that these embodiments are not limited thereto. The embodiments may be changed, modified, combined, and further applied by those skilled in the art. Therefore, these embodiments are not limited to the detail shown and described previously, but also include all such changes and modifications.

The invention claimed is:

1. A securing means for securing a civil engineering element to a construction machine by means of a flexible securing element, wherein a first end of the flexible securing element is attached to the construction machine and a second end is provided with a connecting link which can pass through a through-hole in a securing lug on the civil engineering element and can be releasably fastened to the construction machine by a connecting means, wherein a detection unit is provided on the connecting means, which detection unit is designed for identifying fastening of the connecting link to the connecting means, and the detection unit is configured to generate and output a signal at the identification of fastening of the connecting link to thereby provide information indicating that the connecting link is fastened to the connecting means.

2. The securing means according to claim 1,
wherein
at least one locking bolt is provided on the connecting means, and the connecting link can be locked in the connecting means by the at least one locking bolt.

3. The securing means according to claim 2,
wherein
the at least one locking bolt is adjustably mounted so as to be adjustable between a retracted position for receiving or releasing the connecting link from the connecting means, and a latching position in which the connecting link is locked in the connecting means.

4. The securing means according to claim 1,
wherein
the detection unit can identify a locking position of the connecting link.

5. The securing means according to claim 1,
wherein
the detection unit comprises at least one proximity sensor.

6. The securing means according to claim 5,
wherein
the at least one proximity sensor can identify if the connecting link is located in the connecting means.

7. The securing means according to claim 1,
wherein
the flexible securing element is electrically conductive, and
an electrical energy source is provided, by means of which a test current can be conducted between a fastening element, to which the first end of the flexible securing element is attached, and the connection means through the flexible securing element, which current can be identified by the detection unit.

8. The securing means according to claim 7,
wherein
the fastening element and the connecting means are electrically insulated with respect to the construction machine.

9. The securing means according to claim 1, wherein the construction machine is a pile driver for driving in and/or drawing a pile in the ground.

10. A civil engineering method using a securing means, comprising:
fixing a civil engineering element to a construction machine by means of a flexible securing element,
attaching a first end of the flexible securing element to the construction machine,
providing a second end of the flexible securing element with a connecting link which is passed through a through-hole in a securing lug on the civil engineering element and releasably fastened to the construction machine by a connecting means in order to secure a position of the civil engineering element on the construction machine,
providing a detection unit on the connecting means, which detection unit is designed to identify fastening of the connecting link to the connecting means, and
generating and outputting a signal from the detection unit at identification of fastening of the connecting link, or at identification of a lack of fastening of the connecting link, to thereby provide information indicating that the connecting link is fastened, or not fastened, to the connecting means.

11. The civil engineering method according to claim 10,
driving a pile as the civil engineering element with the construction machine being a pile driver, by means of which the pile, is driven into the ground or drawn out of the ground.

12. The securing means according to claim 1, wherein the flexible securing element is a securing chain.

13. The civil engineering method according to claim 10, wherein the flexible securing element is a securing chain.

14. The securing means according to claim 1, wherein the connecting link has a T-shape.

15. The civil engineering method according to claim 10, wherein the connecting link has a T-shape.

* * * * *